United States Patent [19]

Huntsman et al.

[11] Patent Number: 4,743,917

[45] Date of Patent: May 10, 1988

[54] APPARATUS AND METHOD FOR A PORTABLE ROLL-OUT ANTENNA

[75] Inventors: Craig M. Huntsman, West Valley City; John F. Marshall, Orem, both of Utah

[73] Assignee: Eyring Research Institute, Inc., Provo, Utah

[21] Appl. No.: 779,259

[22] Filed: Sep. 23, 1985

[51] Int. Cl.[4] ..... H01Q 1/12

[52] U.S. Cl. ..... 343/877; 242/54 A

[58] Field of Search ..... 343/725, 803, 821, 823, 343/877; 242/54 A

[56] References Cited

U.S. PATENT DOCUMENTS

| | | | |
|---|---|---|---|
| 1,894,244 | 1/1933 | Ruble | 343/877 |
| 2,161,044 | 6/1939 | Heintz et al. | 173/367 |
| 2,574,733 | 11/1951 | Ehrlich | 250/33 |
| 2,834,012 | 5/1958 | Allen | 343/723 |
| 2,842,768 | 7/1958 | Halperin | 343/877 |
| 3,400,402 | 9/1968 | Gallagher et al. | 343/723 |
| 3,577,148 | 5/1971 | Holzschuh et al. | 343/821 |
| 3,961,589 | 6/1976 | Lombardi | 343/877 X |

*Primary Examiner*—Eugene R. LaRoche
*Assistant Examiner*—Seung Ham
*Attorney, Agent, or Firm*—Workman, Nydegger & Jensen

[57] ABSTRACT

A portable roll-out antenna system which forms a compact, transportable assembly when not being used. The roll-out antenna system is provided with flexible antenna elements which are individually wound onto reels for storage and transportation, and rolled out for use as an efficient antenna system. Each pair of antenna elements is connected to a balun for proper connection to unbalanced connecting cables. The baluns are housed in an end-cap assembly upon which are mounted the antenna element reels when the antenna system is not being used. A power splitter allows more than one connecting cable to be electrically coupled to a remote transmitter/receiver by way of a transmission line. The power splitter is housed in a center reel assembly which is provided with a component to lockably receive part of the end-cap assembly upon which is mounted the antenna-element reels, thus holding the antenna-element reels together and forming a compact, transportable assembly.

57 Claims, 4 Drawing Sheets

APPARATUS AND METHOD FOR A PORTABLE ROLL-OUT ANTENNA

BACKGROUND

1. The Field of the Invention

This invention relates to antennas, more particularly to a portable antenna system wherein the radiating antenna elements and associated conductors are carried on reels for storage and transportation, and wherein the entire antenna system can be rolled out for rapid deployment and use.

2. The Prior Art

The design and manufacture of antennas for radiating radio-frequency electromagnetic waves has been the subject of ongoing research ever since "wireless" communication was first demonstrated. This research has continued to the point where, today, a multitude of different antennas are available for a wide variety of applications. Likewise, the design of radio-frequency transmitting and receiving equipment has also been the subject of extensive research and development. This research, and the general trend toward miniaturization of electronic components, has allowed the design and manufacture of compact, portable radio transmitters and receivers. Many of these transmitters and receivers are capable of being operated virtually anywhere. Presently available portable radio equipment ranges in size from small hand-held transceivers that may be easily carried by a single person, to large units, operated by batteries or a small generator, which are capable of transmitting thousands of watts of radio-frequency energy.

Portable transmitters and receivers have become indispensable in a wide variety of governmental and commercial applications. In particular, portable radio equipment has become an essential tool to police, rescue, and military organizations. For example, in military applications it is highly desirable to be able to move rapidly from one radio transmitting site to another as discretely as possible. Portable radio equipment available today generally is easily transported from one site to another. Antennas, as available previously in the art, however, have often been very difficult to move from site to site. Therefore, an antenna system which is compact and easily transportable, easily hidden, as well as operable in any weather or terrain, would be highly desirable. The antennas, however, that have been available in the art to the present time have generally presented several serious problems when used by organizations such as the military.

The problems encountered in the use of antenna designs found in the prior art stem from the fact that the available antennas which were reasonably portable were generally less efficient than was desirable. Thus, the antenna designer was faced with the choice of designing a very portable antenna or an efficient antenna. Alternatively, in some cases portability could be achieved but the antenna became extremely complex in its construction and deployment, or cumbersome in size and weight, and thus took a substantial period of time to set up as well as presenting other difficulties. An examination of the approaches taken in the prior art demonstrates the difficulties encountered in designing an antenna that is portable and that efficiently radiates and receives radio signals.

One approach taken in the prior art to provide an efficient portable antenna is to modify the design of a rigid-element antenna intended for use as a permanently installed antenna. This modification generally allowed the antenna to be disassembled for transportation from site to site. Furthermore, use of rigid elements in a portable antenna allows the antenna to be of a design similar to a permanently installed fixed-base antenna. Also, the use of a rigid-element antenna generally provides an antenna whose radiation pattern, directivity and standing wave ratio at a particular frequency, is independent of the physical surroundings in which it is operated. There are, however, several problems which accompany the use of rigid-element antennas for use as portable antennas.

The first of these problems is that assembly and disassembly of a rigid-element antenna generally takes a significant amount of time and can also be quite complex. The fact that the antenna takes an extended length of time to assemble or deploy reduces its usefulness with a portable transmitter/receiver. Second, rigid-element antennas, even when disassembled, are often both bulky and heavy, making them difficult to transport. Alternatively, if the weight of the rigid-element antenna is lessened to ease transportation difficulties, the rigid elements of the antenna generally become more fragile requiring greater care in assembly, disassembly, transportation, and use. Third, a rigid-element antenna generally requires suspension above the ground for proper operation. This is usually done by mounting the antenna on a tall mast. The requirement of a mast further increases the difficulty of transporting and assembling the antenna system in addition to providing a very conspicuous marking as to the location of the transmitter/receiver. Such conspicuousness can be a great disadvantage in a military operation. Fourth, the radiation pattern of rigid-element antennas generally cannot be altered easily. Altering the radiation patterns of such antennas generally requires the reorientation of the rigid elements in relation to one another or reorienting the position of the entire antenna system, as well as other system alterations, all of which can be difficult with rigid-element antennas. The above considerations all mitigate against the use of a rigid-element antenna for use with portable radio equipment.

Other types of antennas which have been used with portable radio equipment include single-element antennas often consisting of a single vertical element configured in a flexible "whip" manner. A single-element antenna provides some of the required portability, that is, ease of transportation and assembly, that is desired with portable radio equipment. Such antennas, however, have the drawback of not allowing a wide choice of radiation patterns and often are inefficient radiators and receivers of radio-frequency energy. While the above considerations are relevant to an antenna that is to be operated at any frequency, the above considerations become prominent in the design of an antenna that is to be operated in the high-frequency band, 3 MHz to 30 MHz, and lower frequency bands, such as the medium frequency band, 300 KHz to 3 MHz.

At high and medium frequencies it becomes especially difficult to design an efficient antenna that is still reasonably portable. This can be appreciated by understanding the considerations that apply when determining the necessary length of a half-wave radiating element that is to be operated at 30 MHz. The shortest length of an antenna element which will resonate at a given frequency must be approximately equal to onehalf wavelength of that frequency. A 30 MHz signal has a wavelength of approximately 10 meters. Thus, a half-wave antenna must be approximately five meters in length. It can be appreciated that a rigid antenna element five meters in length can present considerable difficulties when transported. These problems are compounded when designing a portable antenna for use at frequencies lower than 30 MHz.

What is needed in the art is a portable antenna which is simple to transport and store as well as simple to deploy. Furthermore, it would be very advantageous to design a portable antenna which is capable of radiating high transit power efficiently as well as to allow easy alteration of the radiation pattern of the antenna. Still further, it would be an advancement in the art to design a portable antenna which is compact and lightweight and which is impervious to adverse weather conditions as well as easy to maintain.

BRIEF SUMMARY AND OBJECTS OF THE INVENTION

The portable roll-out antenna of the present invention includes a plurality of reel assemblies and a mechanism for locking the reel assemblies together. In the presently preferred embodiment, four of the reel assemblies provide a grooved rim which is rotatably mounted on a support member. A flexible antenna element is wound upon each of the grooved rims during storage and transportation. The flexible antenna elements are rolled out from the grooved rims when setting up the antenna system. Each of the support members of the antenna element reel assemblies is provided with an opening, which may be used as a handhold while winding or unwinding the flexible antenna elements. A connecting cable reel assembly is provided having a fixed grooved rim upon which are wound suitable radio-frequency conductors such as coaxial cables. In the center of this reel assembly is mounted a connecting cable reel assembly housing. A power splitter is mounted in the housing. Connected to the power splitter are the coaxial cables as well as a single connector which is to be attached to a transmission line leading to a transmitter/receiver. The presently preferred embodiment is also provided with end-cap assemblies, each provided with the necessary components for connecting the coaxial cables to the flexible antenna elements which have been unwound from their respective reels. When the antenna elements and connecting conductors are rolled out and properly connected to one another, and to a radio transmitter/-receiver, an efficient radio-antenna system is formed. By winding the elements and conductors onto their respective reels and inserting a portion of the end-cap assembly through the openings provided in the reels, and locking the end-cap assembly to the connecting reel assembly housing, a compact, lightweight, transportable package is formed. The angtenna system is then ready for transportation and storage until deployment of the antenna system is once again desired.

It is therefore a primary object of the present invention to provide a compact, lightweight, transportable, and rapidly deployable antenna system.

Another important object of the present invention is to provide a portable antenna system that efficiently radiates and receives radio signals.

Another important object of the present invention is to provide a portable antenna system that is able to withstand the rigors encountered during portable use and adverse weather conditions.

A further object of the present invention is to provide a portable antenna system which allows the convenient and rapid alteration of its radiation pattern.

Another object of the present invention is to provide a portable antenna apparatus which is lightweight and efficient and yet allows radiation of substantial amounts of radio-frequency energy.

A still further object of the present invention is to provide a portable antenna which may be discretely and inconspicuously deployed.

These and other objects and features of the present invention will become more fully apparent from the following description and appended claims taken in conjunction with the accompanying drawings.

DETAILED DESCRIPTION OF THE PREFERRED EMBODIMENT

Reference is now made to the drawings wherein like parts are designated with like numerals throughout.

Figure 1:
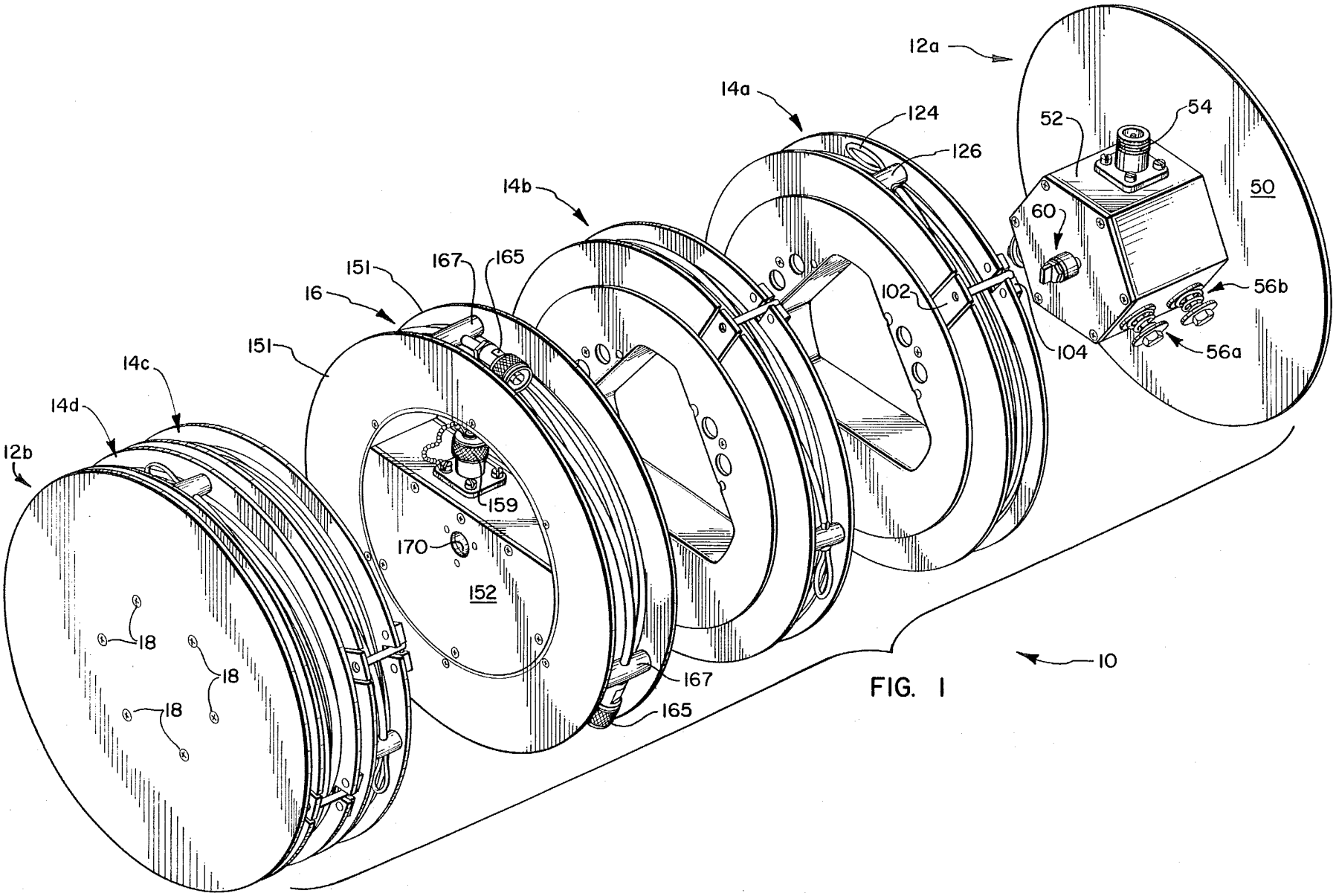
FIG. 1 is a perspective illustration of one presently preferred embodiment of the portable roll-out antenna apparatus of the present invention.

The presently preferred embodiment of the present invention is generally designated at 10 in FIG. 1. It should be understood that the embodiment of the present invention described herein is only one of many possible embodiments that could implement the present invention without departing from the invention as claimed. The portable roll-out antenna generally consists of four antenna-element reel assemblies, generally designated 14*a*14*d*, a connecting cable reel assembly, generally designated 16, and two end-cap assemblies, generally designated 12*a*–*b*. In FIG. 1, antenna-element reel assemblies 14*a* and 14*b*, connecting cable reel assembly 16, and end-cap assembly 12*a* have been separated, and are in a position to have their respective flexible antenna elements and conducting cables rolled out and the antenna systems set up for the transmission and reception of radio signals. Still referring to FIG. 1, antenna-element reel assemblies 14*c* and 14*d* are stacked upon end-cap assembly 12*b* and are in the position that would be taken by these components during preparation of the antenna system for transportation from one site to the next. Antenna-element reel assemblies 14*a–d* are each identical in configuration one to another. Likewise, end-cap assemblies 12*a* and 12*b* are also mechanically identical. Thus, in the subsequent discussion, any description of one component also applies to a similar component.

Figure 3A:
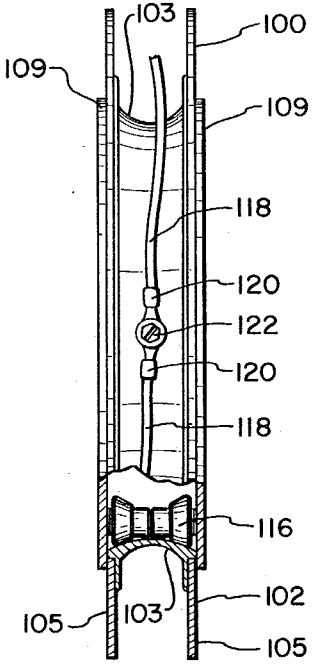
FIG. 3*a* is a side-elevational view of the antenna-element reel assembly partially cut away to show one of the bearing members and a flexible antenna element attached to the assembly.
Figure 3:
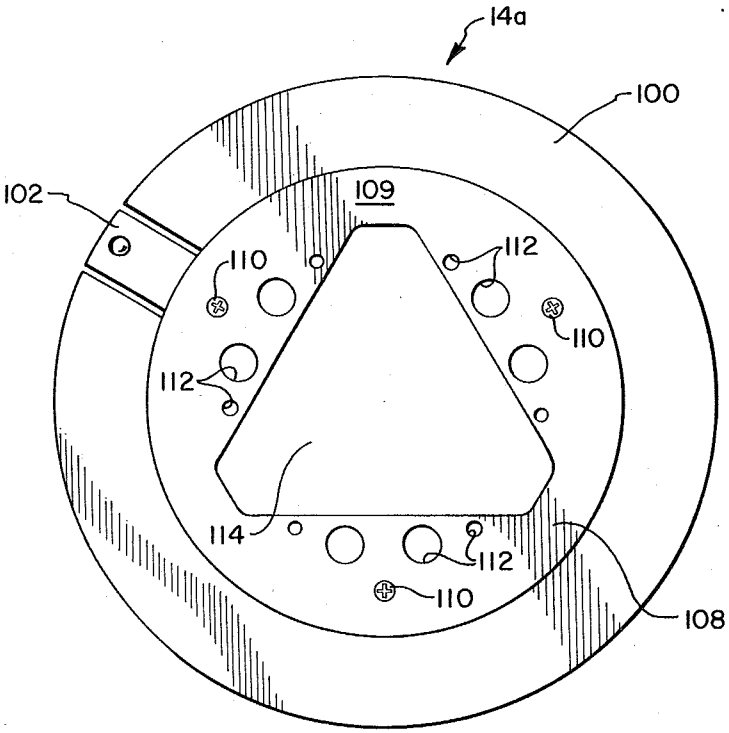
FIG. 3 is a front-elevational view of an antenna-element reel assembly.

The construction of the antenna-element reel assemblies 14*a–d* can best be described by reference to FIGS. 3 and 3*a*. The structure shown in FIGS. 3 and 3*a* is just one of many structures which could be adopted so as to provide a carrier means upon which to wind or store the antenna-element conductors. FIG. 3 is a front-elevated view of the antenna-element reel assesmbly of the presently preferred embodiment. The antenna-element reel assembly 14*a* comprises a reel 100 mounted on a support member 108, and a triangular opening 114 formed through the support member 108. The reel 100 consists of a grooved rim 103, as can be seen best in FIG. 3 a, with extended side members 105 as illustrated in the partial cross section at the bottom of FIG. 3*a*. The dimensions of the grooved rim 103 and extended side members 105 are not critical but must be sufficient to allow the desired length of antenna element 118 to be carried on the reel 100. The length of antenna element 118 that must be carried by the grooved rim is generally determined by the lowest operating frequency at which the antenna will be operated. The antenna element 118 is held onto the grooved rim 103 by lugs 120 (see FIG. 3*a*) which is attached to the antenna element 118. The lugs 120 are held securely to the grooved rim by a screw 122. The unattached end of the antenna element is formed into a loop 124, as can be seen in FIG. 1. A stopper 126, also observable in FIG. 1, is mounted on the antenna element adjacent to the loop 124. The stopper 126, when wedged between the opposing sides 105 of reel 100 holds antenna element 118 tightly on grooved rim 103 so as to prevent it from becoming unwound until desired.

Antenna-element reel 100 is equipped with a hinged handle 104 and a handle-securing mechanism 102. When hinged handle 104 is released from the handle-securing mechanism 102, the handle 104 may be used to facilitate selectively winding or unwinding the antenna element 118 onto, or off from, antenna-element reel 100. Furthermore, when handle 104 is held in a closed position by the handle-securing mechanism 102, the handle 104 assists in preventing antenna element 118 from unwinding off from the reel 100 in the event that the stopper 126 is jarred loose.

The grooved rim 103 of the reel assembly 14*a* is supported by three roller bearings such as the one shown in the cutaway portion of FIG. 3*a* and designated 116. The support member 108 has two opposing flat sides 109. Each of the three roller bearings 116 is attached between opposing sides 109 by a screw 110 as can be seen in FIG. 3. The diameter of the sides 109 is chosen so that the sides 109 slightly overlap the extended side members 105 of grooved rim 103 as shown in FIG. 3*a*. The portion of support member 108 which overlaps the sides 105 of grooved rim 103 assists in keeping the grooved rim 103 in the proper position on the roller bearings 116 by limiting the grooved rim's lateral movement.

Sides 109 of support member 108 are also provided with a plurality of holes 112 which facilitates the cleaning of any dirt or debris that may accumulate between the opposing sides 109 of the support member 108. The triangular opening 114 formed through the center of support member 108 provides a convenient handhold which may be used when rolling out the antenna element 118 or winding the antenna element 118 back onto the reel 100 of assembly 14*a*. Furthermore, opening 114 cooperates with other components to provide a compact, transportable antenna system as will be explained below.

The antenna elements 118 may be of any suitable material which has sufficient strength to withstand periodic flexing and winding. It is also desirable that the antenna elements 118 be corrosion resistant so as to avoid the loss of efficiency in the antenna system due to excessive corrosion on the antenna elements. The antenna element 118 of the presently preferred embodiment is fabricated from a bronze alloy wire with a polyvinylchloride (PVC) insulating jacket. Many wires, however, available in the art could also be used. Likewise, the remainder of the antenna-element reel assembly 14*a* may be constructed of any material which has sufficient structural strength to withstand with rigors of portable use. Because of its light weight and durability, aluminum is one preferred material from which to fabricate the reel 100 and support member 108.

It can be appreciated that by utilizing a flexible, roll-out antenna element 118 many of the difficulties encountered in the prior art by the use of rigid antenna elements can be overcome. The use of a flexible, roll-out antenna element 118 allows for long elements to be wound upon the reels and compactly stored. Furthermore, the antenna may be configured so as to operate in various frequency ranges by winding out more or less of the flexible antenna element 118. An even further advantage of using a flexible, roll-out antenna element 118 is that the positions of the radiating elements relative to one another may be easily altered, thus providing a wider range of design in terms of beam pattern and directionality.

Figure 4:
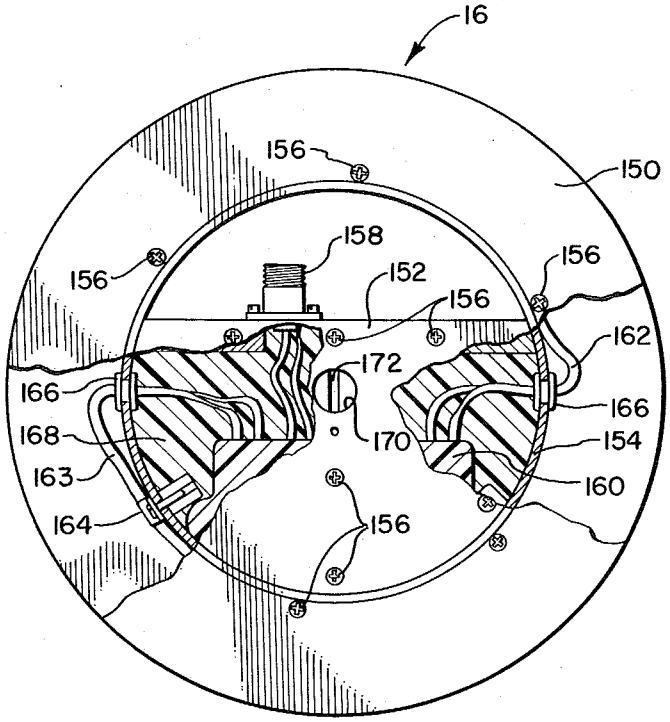
FIG. 4 is a front elevational view of the flexible-conductor reel assembly partially cut away to show the connections of the coaxial cable and external connector to the power splitter mounted in the connecting cable reel assembly housing.

The presently preferred embodiment of the invention also includes a connecting cable reel assembly generally designated at 16 in FIG. 1. As can be seen best in FIG. 4, the connecting cable reel assembly 16 provides a carrier means for cables 162–163 and is provided with a fixed grooved rim 150 upon which connecting cables 162 and 163 are wound. Rim 150 may be partially seen in the cutaway portions of FIG. 4. It should be appreciated that the structure shown in FIG. 4 is one of many structures which could be adopted so as to provide a carrier means upon which to wind or store the connecting cables 162–163. In the presently preferred embodiment, two connecting cables 162–163 are provided; however, this number could be varied according to the application and configuration of the portable antenna system. The grooved rim 150 must be of the appropriate size so that a suitable length of connecting cables 162 and 163 may be wound upon the grooved rim 150. The length of the connecting cables 162 and 163 will be determined by the particular configuration taken when the antenna is rolled out. In the presently preferred embodiment the connecting cables 162 and 163 are coaxial cables of the type that are generally used in radio-frequency communication applications. One end of each of the cables is provided with a male "N" type coaxial connector 165, shown in FIG. 1, as is commonly available in the art. Mounted on the coaxial cable adjacent to the coaxial connector is a stopper 167 which when wedged between the opposing sides 151, as shown in FIG. 1 of the grooved rim 150, serves to hold the coaxial cables 162 and 163 tightly wound upon the grooved rim 150.

The grooved rim 150 of the connecting cable reel assembly 16 is mounted in a fixed position to the connecting cable reel assembly housing 152, as can be seen best in FIG. 4, rather than being rotatably mounted as are the grooved rims 103 of antenna-element reel assemblies 14*a–d*. A housing 152 is also provided on reel assembly 16, as is shown in FIG. 4. The grooved rim 150 and housing 152 of the connecting cable reel assembly 16 is fastened together using screws, indicated at 156, placed about the housing 152 and the inner perimeter of the grooved rim 150.

The housing 152 is provided with a bore 170 as can be seen best in FIG. 4. The bore 170 is centrally located within the radius of the grooved rim 150. Within the bore 170 there is provided a slot 172. The slot 172 may be configured so as to provide a continuous passageway from the first side of the housing 152 to the second side of the housing 152. Slot 172 cooperates with end-cap assemblies 12*a–*12*b* so as to provide a means for securing each reel assembly 14*a–*14*d* when they are mounted on the end-cap assemblies 12*a–*12*b* as explained more fully below.

The connecting cable reel assembly 16 may be fabricated out of any material suitable to withstand the rigors of portable use. The presently preferred material for fabrication of connecting cable reel assembly 16 is aluminum. Furthermore, it should be appreciated that the particular structure shown in the presently preferred embodiment is only one of many configurations which could perform the same function as the structure shown.

The remainder of the electrical components associated with the connecting cable reel assembly 16 is shown best in FIG. 4. In the presently preferred embodiment a female "N" type coaxial connector 158, functioning as a transmission line connector, is mounted upon the surface of the connecting cable reel assembly housing 152. As shown in FIG. 1, connector 158 may include an attached cap 159. Further, the transmission-line connector 158 is mounted on top of housing 152 (see also FIG. 1) so as not to increase the overall width of the assembly 16 beyond the width of the rim 150. When the antenna system of the present system is rolled out and configured for use in the transmission and reception of radio signals, the transmission line leading to the remote radio transmitter/receiver, or other radio component, is connected to transmission line connector 158. When used with the presently preferred embodiment, the transmission line should be terminated in a connector compatible with transmission line connector 158 and also be of the unbalanced type such as a coaxial cable with its shield connected to ground. As will be appreciated by those who are skilled in the art of antenna design, other types of transmission lines and/or connectors could be utilized without departing from the invention as claimed.

Referring again to FIG. 4, the transmission line connector 158 is connected to a power-splitter 160, which is partially shown in the cutaway portions of FIG. 4. In the presently preferred embodiment the power splitter 160 is of the two-way type. The power splitter 160 can be one of any type of power splitters which are well-known in the art of antenna design. However, attention must be paid to considerations such as power-handling capacity, operating frequency range, and physical size when choosing a power splitter for use in the present invention.

Coaxial cables 162 and 163 are directly connected to the power splitter 160. Coaxial cables 162 and 163 pass through the grooved rim 150. At the point where the coaxial cables 162 and 163 pass through the grooved rim 150, grommets, indicated at 166, are positioned around coaxial cables 162 and 163 so as to prevent damage to the cables. Furthermore, strain reliefs, indicated at 164, are provided for each of the cables, though only one strain relief is shown in the cutaway portion of FIG. 4, to prevent excessive tension from being exerted on coaxial cables 162 and 163 at the point where they pass through grooved rim 150. Filler material 168 is provided in the cavity of connecting cable reel assembly housing 152. The filler material in the presently preferred embodiment is a silicon-based resilient material such as that known in the art as RTV. By the particular configuration shown for a conducting cable reel assembly 16, a compact unit is formed upon which the cables necessary to connect various antenna elements may be carried, in addition to providing a way of carrying the power splitter which is necessary to properly connect the present embodiment of the roll-out antenna system.

The roll-out antenna system is also provided with two end-cap assemblies, designated 12*a–*12*b* in FIG. 1. Each of the end-cap assemblies 12*a* and 12*b* are identical, therefore the subsequent description applies equally well to either end-cap assembly 12*a* or 12*b*. FIG. 2 is a front elevational view of end-cap assembly 12*a*. The end-cap assembly is generally provided with an end plate 50, and a hub 52. The hub 52 in the presently preferred embodiment is of polygonal shape. The end plate 50 is fabricated of aluminum in the presently preferred embodiment but could be of any material with sufficient strength. It will also be appreciated that the same function of end plate 50 could be performed by a variety of structures, such as arm-like structures extending radially from hub 52. End plate 50 in the presently preferred embodiment is of approximately equal diameter as the reels 100 of antenna element assemblies 14*a–*14*d*.

Upon one side of end plate 50 is mounted the hub 52. The hub is held in place by screws 18 which are shown best in FIG. 1 on end-cap assembly 12*b*. The polygonal shape of the hub 52 as used in the presently preferred embodiment can be seen best in FIG. 2. FIG. 2*a* provides a side-elevated view of the hub 52. The internal cavity of the hub 52 is enclosed by a hub cover 59 as shown in FIG. 2*a*. The hub cover 59 is secured onto the hub 52 by screws 58, which are shown in FIG. 2. In the presently preferred embodiment two pair of spring-loaded antenna element connectors, 56*a–*56i b, and 56*c–*56*d*, are mounted on the surface of hub 52. Also, a female "N" type coaxial connector 54 is mounted on thye surface of the hub 52. Hub 52 is constructed of a nonconducting material such as nylon so as to reduce capacitive coupling between antenna connectors 56*a–*56*d*. Each pair of antenna connectors, 56*a–*56*b* and 56*c–*56*d*, are provided so as to allow more efficient antenna operation in particular bandwidths.

N-type connector 54 is to be attached to one connecting cable 162 or 163 found on connecting cable reel assembly 16. Thus, the hub connector 54 is connected to the remote transmitter/receiver by way of a connecting cable 162 or 163, the power splitter 160, and the transmission line connector 158. Hub connector 54 is also connected to a balun 78, which is shown best in the cutaway portions of FIGS. 2 and 2*b*. Balun 78, which provides a transformation from an unbalanced signal to a balanced signal, is configured so as to be tapped at two different transformation ratios. Antenna connector pair 56*a* and 56*c* are connected to balun 78 at the points on balun 78 which provide a first transformation ratio. Antenna connector pair 56*b* and 56*d* are connected to balun 78 at a point which provides a second transformation ratio. Thus, antenna connectors 56*a*–56*d* are connected to a remote transmitter receiver when the antenna system is deployed by way of balun 78, hub connector 54, and the signal path described above. Multiple antenna connectors, providing different transformation ratios by way of balun 78 are provided because it has been found that the roll-out antenna system of the present invention provides more efficient operation at particular frequencies when particular transformation ratios are provided by balun 78. Therefore, it will be appreciated that particular applications in which the present invention may be used may require the alteration of the components or structure shown in the presently preferred embodiment but yet still come within the scope of the invention as claimed. The internal cavity of hub 52 is provided with a resilient filler material 77 to hold balun 78 in the proper position and also another resilient filler material 76 to protect balun 78 and wiring connections within hub 52 from damage.

Each of the four antenna-element connectors 56*a*–56*d* of the presently preferred embodiment are of identical construction. The structure of the antenna element connectors 56*a*–56*d* can be seen best in the cross-sectional view of FIG. 2*b*. A corrosion-resistant bolt 80 is the central component of antenna-element connector 56*b*. Antenna connector bolt 80 is provided with a notch 81 on its shaft near the head of the bolt. A washer 82 is biased at the head of bolt 80 by a spring 84. The antenna-element connectors 56*a*–56*d* are isolated from the hub 52 by an insulated washer 86 and an insulated bushing 88. Connections from balun 78 are made by way of wires which are provided with lugs 90 which are then frictionally fitted to the shaft of bolt 80 by way of a lock washer 92 and nut 94 engaged onto the connector bolt 80. A portion of the wiring from balun 78 to antenna connectors 56*a*–56*d* may be seen in the cutaway portion of FIG. 2.

Figure 2B:
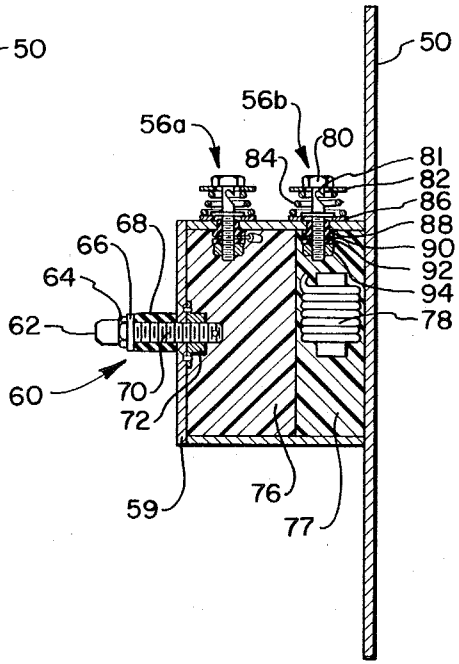
FIG. 2*b* is a cross section of the end-cap assembly taken along line 2*b*—2*b* of FIG. 2.
Figure 2A:
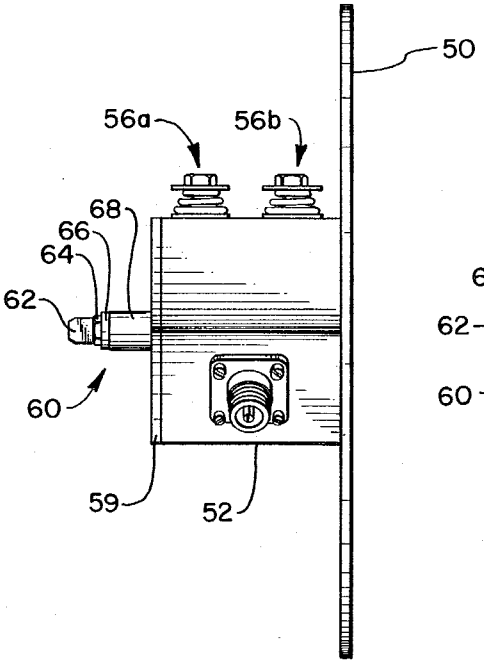
FIG. 2*a* is a side-elevational view of the end-cap assembly illustrated in FIG. 2.
Figure 2:
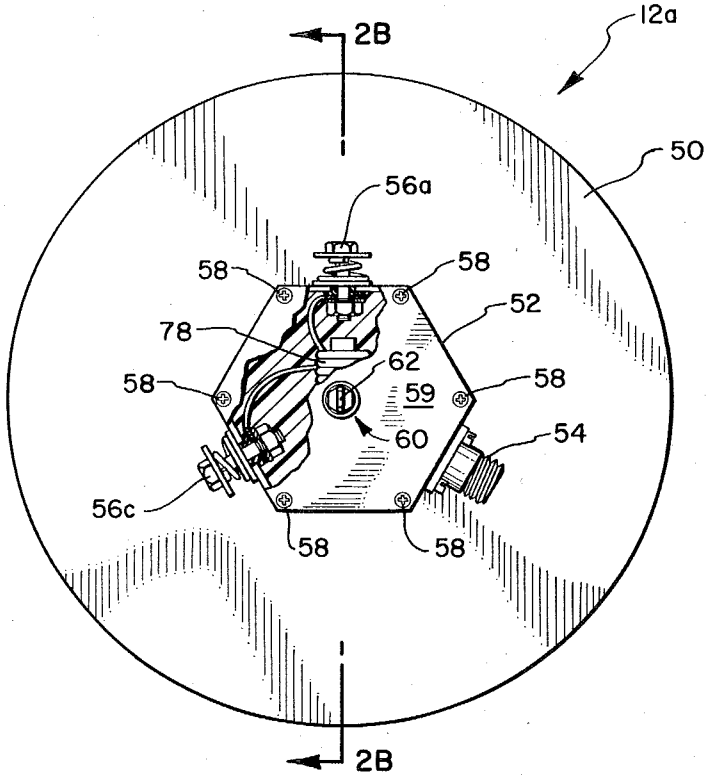
FIG. 2 is a front-elevational view of an end-cap assembly partially cut away to show some of the connections between the balun and the antenna connectors.

The notch 81 provided in bolt 80, as shown in FIG. 2B, of of the proper size so as to allow the loop 124 formed on the end of antenna elements 118, as shown in FIG. 1, to be inserted into the notch 81 when washer 82 is pushed downward beyond the notch. Once the antenna-element loop 124 is inserted into the notch, washer 82 is released and antenna-element loop 124 is securely held in the notch 81 providing a good electrical connection. Furthermore, by the structure incorporated in the presently preferred embodiment, an antenna-element connector is provided that allows rapid attachment and removal of the antenna elements as well as providing a simple mechanical structure that is not difficult to fabricate or repair.

The hub cover 59 is provided with a post generally designated at 60 in FIGS. 2, 2A and 2B. The post 60 is provided with a flat blade 62 mounted on the post head 64, the post head 64 being attached to the post screw 70 as can be seen best in FIG. 2A. The post screw 70 is inserted through an opening in the hub cover 59. The threads of the post screw 70 are engaged by the threads of the nut 72. The nut 72 is centrally affixed to the inside surface of the hub cover 59. The portion of the post screw 70 which is exterior to the hub cavity is surrounded by a gasket 68. The gasket 68 is made of a resilient rubber-like material which may be compressed and released without incurring any permanent deformity. A washer 66 is provided between the post head 64 and the gasket 68. By this structure, it is possible to compress gasket 68 by rotating the post blade 62. This is accomplished because as post blade 62 is rotated in the appropriate direction the distance between post washer 66 and the hub cover 59 is decreased, compressing the gasket 68 and causing it to expand its circumference in response to the increased pressure. The gasket 68 may be returned to its original circumference by rotation of the post blade 62 in the reverse direction.

When the portable roll-out antenna of the presently preferred embodiment is to be stored or transported, the antenna elements are wound upon their respective antenna-element reels 14*a*–14*d* and connecting cables 162 and 163 are wound upon the connecting cable reel assembly 16. With the antenna elements and connecting cables wound upon their respective reels, the presently preferred embodiment may be formed into a compact transportable package by stacking two of the antenna-element reel assemblies, such as 14*c*–14*d* as shown in FIG. 1, onto the hub 52 of the end-cap assembly 12*a* or 12*b*. The opening 114 of the antenna-element reel assembly is shaped so as to complement the polygonal shape of hub 52. The distance at which hub 52 extends outwardly from end plate 50 corresponds to the width of two antenna-element reel assemblies such as 14*a*–14*b* or 14*c*–14*d*. By fabricating hub 52 so as to match the dimensions of opening 114 and the width of two antenna-element reels 14*a*–14*b*, the exterior surface of hub cover 59 will fit flush against one side of connecting cable reel assembly housing 152 when post 60 and hub 52 are inserted through the openings 114 of either pair of antenna-element reel assemblies 14*a*–14*b* or 14*c*–14*d*. Post 60 is then received into bore 170. The post blade 62 is received into the bore slot 172. Once the post 60 and the post blade 62 have been properly received by the bore 170 and the bore slot 172, and a pair of antenna-element reel assemblies have been stacked on the hub 52, the end-cap assembly, 12*a* or 12*b*, may be locked into position by rotating end plate 50 so as to cause the compression of gasket 68 creating a frictional fit between the gasket 68 and bore 170. Thus, a compact, transportable package is formed in which all of the electrical and physical components necessary for operation of the roll-out antenna of the present invention are included and may be easily transported or stored. As presently embodied, the portable roll-out antenna weighs less than 17 pounds, is less than eight inches in length and 9 inches in diameter.

When operation of the presently preferred embodiment of the present invention for use in transmitting and receiving radio signals is desired, the antenna-element reel assemblies 14*a*–14*d* and the end-cap assemblies 12*a*–12*b* are separated from the connecting cable reel assembly 16 in a manner the reverse of that described for assembly as described above. The antennt elements 118 are then rolled out from their respective reels 14*a*–14*d*.

Figure 5:
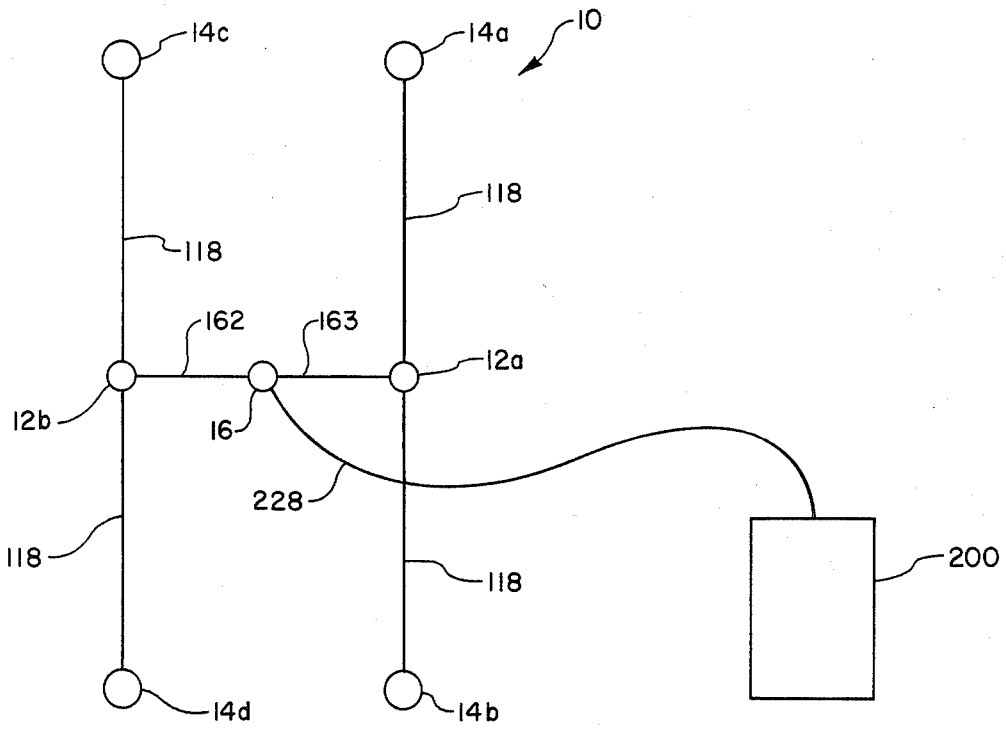
FIG. 5 is a representation of one possible configuration which the presently preferred embodiment of the present invention may take after the antenna elements and conductors have been rolled out from their respective reels and have been attached to a remote transmitter/receiver.

In the presently preferred embodiment it has been found that an efficient antenna may be formed by rolling out the antenna elements 118 and laying them directly onto the ground or supporting them slightly off the ground in the pattern shown in FIG. 5. The length of antenna element which is rolled out is dependent upon the frequency at which the antenna system is to be operated. The antenna-element loop 124 is individually attached to the appropriate antenna connector 56*a*–56*d* on an end-cap assembly hub 52 according to the desired operating frequency range of the antenna system. Each hub connector (see FIG. 2) is then connected to one connecting cable 162 or 163. Having connected the connecting cables 162 and 163 to the hub connectors of end-cap assemblies 12*a* and 12*b*, the antenna elements 118 are able to receive a signal from, or pass a signal to, power splitter 160. The number of antenna elements 118 selected for use can vary. A single element can be hooked up and used, or a plurality of elements 118 can be connected together as described above, depending on the operational characteristics of the system that is designed. A transmission line 228 connects power-splitter 160 of reel assembly 16 to a remote transmitter/-receiver represented by the block designated 200. By this structure and configuration the portable roll-out antenna of the present invention may be used as an efficient radio antenna system.

It will be appreciated that the apparatus and method of the present invention is capable of being incorporated in a variety of embodiment, only one of which has been illustrated and described above. The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured to United States Letters Patent is:

1. A portable roll-out antenna system comprising:

first carrier means for carrying a first conductor such that said first conductor can be selectively wound onto said first carrier means when transporting said antenna system, and such that said first conductor can be selectively unwound from said first carrier means when setting up said antenna system for use in transmitting and receiving radio signals;

second carrier means for carrying a second conductor such that said second conductor can be selectively wound onto said second carrier means when transporting said antenna system, and such that said second conductor can be selectively unwound from said second carrier means when setting up said antenna system for use in transmitting and receiving radio signals; and means for selectively locking and unlocking said first and second carrier means together such that a compact, transportable assembly is formed when said first and second conductors are wound up and said carrier means are locked together, and such that a rapidly deployable antenna system is formed when said carrier means are unlocked and said first and second conductors are unwound, said means for locking and unlocking comprising means for electrically connecting one end of said first and second conductors to a remote transmitter/receiver.

2. A system as defined in claim 1 wherein said first and second carrier means each comprise a reel assembly comprising:

a support member, said support member having a plurality of bearing members mounted to the support member; and a grooved rim rotatably supported on said bearing members such that said rim can be rotated while said support member is held stationary so as to selectively wind and unwind said conductors onto and off of said grooved rim.

3. A system as defined in claim 2 wherein said support member of each said carrier means comprises means for forming a handhold for holding said support member stationary as said grooved rim is rotated.

4. A system as defined in claim 3 wherein said means for forming said handhold comprises an opening formed through the center of said support member.

5. A system as defined in claim 4 wherein said opening has a polygonal perimeter.

6. A system as defined in claim 2 wherein said grooved rim comprises a means for releasably holding said conductor on said rim.

7. A system as defined in claim 6 wherein said means for releasably holding said conductor comprises a hinged handle and a handle-securing mechanism, such that said hinged handle restricts the unwinding of said conductor when said folding handle is received by said handle-securing mechanism.

8. A system as defined in claim 4 wherein said support members each comprise two opposing sides spaced apart by said bearing members.

9. A system as defined in claim 8 wherein said sides of each said support member comprise a plurality of holes formed therethrough.

10. A system as defined in claim 8 wherein said sides of each said support member overlap a portion of the inner perimeter of said grooved rim.

11. A system as described in claim 2 wherein one end of each said conductor is attached to said grooved rim.

12. A system as described in claim 11 wherein the unattached end of each said conductor has a loop formed thereon.

13. A system as described in claim 12 wherein said system further comprises a stopper attached to said conductor adjacent said loop.

14. A system as defined in claim 4 wherein said locking and unlocking means comprises:

an end-cap assembly comprising an end plate and a hub mounted on said end plate, said hub being adapted for insertion through said openings formed through the support members of said reel assemblies, such that said reel assemblies are mounted on said hub when so inserted;

a third carrier means for carrying a connecting cable such that said cable can be selectively wound onto said third carrier means when transporting said antenna system, and such that said cable can be selectively unwound from said third carrier means when setting up said antenna system for use; and means for releasably securing said third carrier means and said end-cap assembly together.

15. A system as defined in claim 14 wherein said hub comprises:

a connector for attaching said connecting cable of said third carrier means to said hub;

a plurality of connectors for attaching one end of each said conductor of said first and second reel assemblies to said hub; and means housed within said hub for electrically connecting said cable and said conductors when said cable and said conductors are connected to said hub.

16. A system as defined in claim 15 wherein said means housed within said hub comprises a balun mounted within said hub and a filter material for filling said hub so as to surround said balun with said filler material to protect said balun.

17. A system as described in claim 15 wherein said hub is constructed from a nonconductive material such that said hub will not be capacitively coupled to said connectors.

18. A system as defined in claim 15 wherein said plurality of connectors comprises at least two pair of connectors, each said pair of connectors being connected to said balun so as to provide a first and a second frequency bandwidth over which said antenna system is operated depending upon which pair of connectors said conductors are attached to.

19. A system as defined in claim 14 wherein said third carrier means comprises a reel assembly comprising a grooved rim and a housing mounted at the center of said grooved rim, said housing having a power splitter mounted therein and a cable connector mounted to said housing connected to said power splitter, and said cable of said third carrier means being connected to said power splitter.

20. A system as defined in claim 19 further comprising a filler material contained in said housing so as to surround said power splitter with said filler material in order to protect said power splitter.

21. A portable roll-out antenna system comprising:

first carrier means for carrying a first conductor and comprising a rotatable reel such that said first conductor can be selectively wound onto said reel when transporting said antenna system, and such that said first conductor can be selectively unwound from said reel when setting up said antenna system for use in transmitting and receiving radio signals;

means for electrically connecting said first conductor to a remote transmitter/receiver; and means for stacking and selectively locking and unlocking said first carrier means and said means for electrically connecting said first conductor together so as to form a compact assembly that is stacked when transporting the antenna system and that is unlocked and unstacked when deploying the antenna system for operation.

22. A portable roll-out antenna system comprising:

a first reel assembly;

a first antenna element mounted on said first reel assembly, such that said first antenna element can be selectively wound upon said first reel assembly when transporting said antenna system and selectively unwound from said first reel assembly when setting up said antenna system for use in transmitting and receiving radio signals;

a second reel assembly;

a second antenna element mounted on said second reel assembly, such that said second antenna element can be selectively wound upon said second reel assembly when transporting said antenna system and selectively unwound from said second reel assembly when setting up said antenna system for use in transmitting and receiving radio signals;

a third reel assembly;

a plurality of flexible cables that can be selectively wound upon said third reel assembly when transporting said antenna system and selectively unwound from said third reel assembly when setting up said antenna system for use in transmitting and receiving radio signals;

an end-cap assembly;

means for selectively locking and unlocking said first, second and third reel assemblies and said end-cap assembly together such that a compact, transportable assembly is formed when said first, second and third reel assemblies and said end-cap assembly are locked together, and such that a rapidly deployable antenna system is formed when said first, second and third reel assemblies and said end-cap assembly are unlocked and said first and second antenna elements are unwound; and means for connecting said antenna elements to said plurality of flexible cables.

23. A system as defined in claim 22 wherein said first and second reel assemblies each comprises:

a support member, said support member having a plurality of bearing members mounted on the support member; and a grooved rim rotatably supported on said bearing members such that said rim can be rotated while said support member is held stationery so as to selectively wind and unwind said antenna elements onto and off of said grooved rim.

24. A system as defined in claim 23 wherein said support member of each said first and second reel assembly comprises means for forming a handhold for holding said support members stationary as said grooved rim is rotated.

25. A system as defined in claim 24 wherein said means for forming said handhold comprises and opening formed through the center of said support member.

26. A system as defined in claim 25 wherein said opening has a polygonal perimeter.

27. A system as defined in claim 23 wherein said grooved rim comprises a hinged handle and a handle-securing mechanism, such that said hinged handle restricts the unwinding of said antenna element when said folding handle is received by said handle-securing mechanism.

28. A system as defined in claim 23 wherein said support members each comprise two opposing sides spaced apart by said bearing members.

29. A system as defined in claim 28 wherein said sides of each said support member comprise a plurality of holes formed therethrough.

30. A system as defined in claim 29 wherein said sides of each said support member overlap a portion of the inner perimeter of said grooved rim.

31. A system as defined in claim 23 wherein one end of each said antenna element is attached to said grooved rim.

32. A system as described in claim 31 wherein the unattached end of each said antenna element has a loop formed thereon.

33. A system as described in claim 32 wherein said system further comprises a stopper attached to said antenna element adjacent said loop.

34. A system as defined in claim 25 wherein said third reel assembly comprises:

a grooved rim; and a housing formed at the center of said grooved rim.

35. A system as defined in claim 34 further comprising a power splitter mounted in said housing.

36. A system as defined in claim 35 wherein said power splitter is a two-way power splitter.

37. A system as defined in claim 35 further comprising a filler material contained in said housing so as to surround said power splitter with said filler material in order to protect said power splitter.

38. A system as defined in claim 35 further comprising a connector mounted on said housing.

39. A system as defined in claim 35 wherein said plurality of said flexible cables are connected to said power splitter.

40. A system as defined in claim 39 wherein said plurality of said flexible cables comprises coaxial cables.

41. A system as defined in claim 34 wherein said end-cap assembly comprises:

an end plate; and a hub mounted on said end plate, said hub being adapted for insertion through said opening formed through the support members of said reel assemblies, such that said reel assemblies are mounted on said hub when so inserted.

42. A system as defined in claim 41 wherein said means for connecting said antenna elements to said plurality of flexible cables comprises:

a connector mounted on said hub connection to one of said plurality of flexible cables;

a plurality of antenna element connectors for connection to antenna elements; and a balun connected between said connector mounted on said hub and said plurality of antenna-element connectors, said hub connector and plurality of antenna-element connectors mounted on said hub and said balun mounted within said hub.

43. A system as defined in claim 42 wherein said plurality of antenna connectors comprises at least two pair of antenna connectors, each said pair of antenna connectors being connected to said balun so as to provide first and second frequency bandwidths over which said antenna system is operated depending upon which pair of connectors said antenna elements are attached to.

44. A system as defined in claim 42 further comprising a filler material contained in said hub so as to surround said balun with said filler material in order to protect said balun.

45. A system as defined in claim 41 further comprising:

a fourth reel assembly;

a fourth antenna element mounted on said fourth reel assembly such that said fourth antenna element can be selectively wound upon said fourth reel assembly when transporting said antenna system and selectively unwound from said fourth reel assembly when setting up said antenna system for use in transmitting and receiving radio signals;

a fifth reel assembly;

a fifth antenna element mounted on said fifth reel assembly such that said fifth antenna element can be selectively wound upon said fifth reel assembly when transporting said antenna system and selectively unwound from said fifth reel assembly when setting up said antenna system for use in transmitting and receiving radio signals; and a second end-cap assembly.

46. A system as defined in claim 45 further comprising a means for selectively locking and unlocking said third, fourth and fifth reel assemblies and said second end-cap assembly such that a compact, transportable assembly is formed when said third, fourth and fifth reel assemblies and said second end-cap assembly are locked together, and such that a rapidly deployable antenna system is formed when said third, fourth and fifth reel assemblies and said second end-cap assembly are unlocked and said fourth and fifth antenna elements are unwound.

47. A portable roll-out antenna system comprising:

a plurality of reel assemblies for carrying antenna elements each comprising:

a first rim;

a plurality of bearing members, said first rim rotatably supported on said bearing members;

a support member upon which are mounted said bearing members, said support member having an opening formed through the center thereof; and a flexible antenna element which may be selectively wound onto said first rim during transportation of said antenna system and rolled out from sid first rim when setting up said antenna system for use in transmitting and receiving radio signals;

a reel assembly for carrying a connecting cable comprising:

a second rim;

a plurality of flexible cables, said cables being selectively wound onto said second rim for transportation of said antenna system and rolled out from said second rim when setting up said antenna system for use in transmitting and receiving radio signals;

a housing, said housing being formed near the center of said second rim;

a housing connector adapted for attachment to a transmission line leading to a remote transmitter/receiver;

a power splitter mounted within said housing and connected to said housing connector and to one end of each of said plurality of flexible cables; and an end-cap assembly comprising:

an end plate having a hub formed thereon, said hub being adapted for insertion through said openings of each said support member;

a hub connector adapted for attachment to the other end of one of said plurality of flexible cables, said hub connector being mounted on said hub;

a plurality of antenna connectors adapted for attachment to an end of one of said flexible antenna elements;

a balun connected between said hub connector and said plurality of said antenna connectors so as to provide operation of said antenna system in multiple-frequency bandwidths, said balun being mounted within said hub; and means for selectively locking and unlocking said end-cap assembly to and from one of said reel assemblies so as to form a compact, transportable antenna system.

48. A method of setting up and taking down a portable roll-out antenna system, said system comprising a plurality of antenna-element conductors stored on their respective carrier means, and a plurality of connecting cables, said method comprising the steps of:

locking said antenna-element carrier means together so as to form a compact, transportable package;

unlocking said antenna-element carrier means and rolling out a plurality of antenna-element conductors from their respective carrier means;

electrically coupling each said antenna-element conductor to a connecting cable; and electrically coupling each said connecting cable to a remote transmitter/receiver transmission line.

49. The mtehod defined in claim 48 wherein the step of rolling out a plurality of antenna-element conductors further comprises the step of rolling out said plurality of antenna-element conductors onto the ground.

50. The method defined in claim 48 wherein the step of rolling out a plurality of antenna-element conductors further comprises the step of arranging said plurality of antenna-element connectors in a desired pattern.

51. The method defined in claim 48, wherein said system further comprises a connecting cable carrier means, said method further comprising the step of rolling out said connecting cables from said connecting cable carrier means.

52. The method defined in claim 48, wherein said system can selectively operate at any one of a plurality of operating frequencies, and wherein said step of rolling out a plurality of antenna-element conductors further comprises the step of rolling out a particular length of said antenna-element conductors such that said antenna-element conductors resonate at said selected operating frequency.

53. The method defined in claim 48, wherein said system further comprises a balun for electrically coupling said antenna-element conductor to said connecting cable, and wherein the step of electrically coupling each said antenna-element conductor to a connecting cable further comprises the step of connecting said antenna-element conductors and said connecting cables to a balun.

54. The method as defined in claim 53, wherein said system further comprises a balun having one primary terminal and a plurality of secondary terminals, and wherein the step of electrically coupling each said antenna-element conductor to a connecting cable further comprises the step of connecting each said antenna-element conductor to at least one secondary terminal and connecting said connecting cable to said primary terminal.

55. The method defined in claim 48, wherein said system further comprises a power splitter for electrically coupling a plurality of connecting cables to said transmission line, and wherein said step of electrically coupling each said connecting cable to a remote transmitter/receiver transmission line further comprises the step of connecting said connecting cables to said power splitter.

56. The method as defined in claim 48 further comprising the step of reqinding each said antenna element back onto its respective carrier means.

57. A portable roll-out antenna system comprising:

first and second carrier means for carrying first and second conductors, respectively, such that said conductors can be selectively wound onto their respective carrier means when transporting said antenna system, and such that said conductors can be selectively unwound from their respective carrier means when setting up said antenna system for use in transmitting and receiving radio signals, each said carrier means comprising a support member having a plurality of bearing members mounted to the support member, and a rim rotatably supported on said bearing member such that said rim can be rotated while said support member is held stationary so as to selectively wind and unwind said conductors onto and off of said rim, each said support member having an opening formed through the center thereof; and means for selectively locking and unlocking said first and second carrier means together such that a compact, transportable assembly is formed when said first and second conductors are wound up and said carrier means are locked together, and such that a rapidly deployable antenna system is formed when said carrier means are unlocked and said first and second conductors are unwound, said locking and unlocking means comprising:

means for electrically connecting one end of said first and second conductors to a remote transmitter/receiver;

an end-cap assembly comprising an end plate and a hub mounted on said end plate, said hub being adapted for insertion through said opening of and said support member, such that said support member is mounted on said hub when so inserted;

a third carrier means for carrying a connecting cable such that said cable can be selectively wound onto said third carrier means when transporting said antenna system, and such that said cable can be selectively unwound from said third carrier means when setting up said antenna system for use; and means for releasably securing said third carrier means and said end-cap assembly together.

* * * * *

UNITED STATES PATENT AND TRADEMARK OFFICE

CERTIFICATE OF CORRECTION

PATENT NO. : 4,743,917

DATED : May 10, 1988

INVENTOR(S) : Craig M. Huntsman et al.

It is certified that error appears in the above-identified patent and that said Letters Patent is hereby corrected as shown below:

Column 11, line 24, "variety of embodiment" should be --variety of embodiments--

Column 14, line 19, "each comprises:" should be --each comprise--

Column 14, lines 34-35, "and opening" should be --an opening--

Column 17, line 8, "mtehod" should be --method--

Signed and Sealed this

Thirty-first Day of October, 1989

*Attest:*

*Attesting Officer*

DONALD J. QUIGG

*Commissioner of Patents and Trademarks*